United States Patent [19]

Bartsch et al.

[11] 4,157,754

[45] Jun. 12, 1979

[54] PACKAGING FOR COMPRESSED FIBERS, FILAMENTS OR CABLED TOWS

[75] Inventors: Rudolf Bartsch, Emmendingen; Bruno Bölter, Umkirch; Ulrich Köhler, Kirchzarten; Josef Ritschel, Freiburg im Breisgau, all of Fed. Rep. of Germany

[73] Assignee: Deutsche Rhodiaceta AG, Freiburg im Breisgau, Fed. Rep. of Germany

[21] Appl. No.: 847,576

[22] Filed: Nov. 1, 1977

[30] Foreign Application Priority Data

Nov. 13, 1976 [DE] Fed. Rep. of Germany ..... 7635849

[51] Int. Cl.[2] ..... B65D 71/00

[52] U.S. Cl. ..... 206/83.5; 53/383; 428/2

[58] Field of Search ..... 53/383; 206/83.5; 229/87 R; 428/2

[56] References Cited

U.S. PATENT DOCUMENTS

| | | | |
|---|---|---|---|
| 1,452,100 | 4/1923 | Wheildon | 206/83.5 |
| 2,700,459 | 1/1955 | Anspacher | 206/83.5 X |
| 2,880,866 | 4/1959 | Van Dyck | 206/83.5 |
| 3,206,021 | 9/1965 | Smith et al. | 206/83.5 |
| 3,458,966 | 8/1969 | Dunbar et al. | 206/83.5 |

*Primary Examiner*—Davis T. Moorhead

*Attorney, Agent, or Firm*—Bucknam and Archer

[57] ABSTRACT

Compressed fibers, filaments or cabled tows, which are under an internal pressure of at least 0.2 daN/cm$^2$ are packaged by means of an outer wrapping, and the overlapping areas of the wrapping are held together by means of an adhesive, for instance a neoprene-chloroprene-rubber based adhesive. In this manner, it is possible to eliminate straps, belts or wires which have been conventionally used to hold the package.

5 Claims, 1 Drawing Figure

PACKAGING FOR COMPRESSED FIBERS, FILAMENTS OR CABLED TOWS

Figure 1:
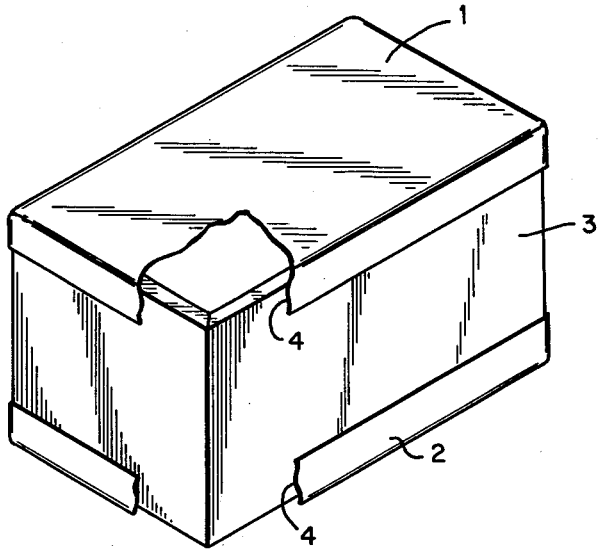

This invention relates to compressed fibers, filaments or cabled tows and more specifically it relates to a packing for compressed fibers, filaments or cabled tows which is subjected to an internal pressure of at least 0.2 daN/cm$^2$.

The invention relates in particular to a packing of compressed cabled tows intended for processing into tobacco smoke filter elements and subjected to an internal pressure of at least 0.2 daN/cm$^2$.

It is known from German Utility Model No. 1,881,067 that fibers such as cotton, wool, rayon staple, totally synthetic fibers and the like are packed by compressing them under high pressure in special machines and then holding them together by means of a wrapping and with straps, for instance steel straps. When the fibers are to be used, the fiber bales are opened by removing the straps and the wrapping.

German Utility Model No. 1,967,230 describes a packing for bales of compressed textile cables, for instance from crimped cellulose acetate filaments intended for processing into tobacco smoke filter elements. This known packing is made of several parts and consists of an aluminum foil coated with polyolefin and, if applicable, with cellulose, and of an outer wrapping of a material resembling corrugated paper.

For the purpose of imparting sufficient firmness to this packing, the bale is bound in all three directions with straps or belts, according to German Utility Model No. 1,967,230, the straps or belts being made either of metal or alloys such as steel, or leather or plastic material or the like.

These known packagings have the disadvantage that straps made of steel, belts, wires or the like in order to hold the individual parts of the packaging together and to withstand the high internal pressure, must be tied around the fiber or filament bales. This renders the packing considerably more expensive. Further the handling of the bales with these straps is not harmless because they have very sharp edges.

Another disadvantage of the known packings for compressed fibers, filaments or cabled tows is that in order to open the package, the straps or similar holding means must first be removed. Due to the high internal pressure of the package the ends of the holding means when cut snap apart, which in turn results in an increased risk of accident and injury.

Still another disadvantage is that the holding means cut into the packaging and particularly into the edges due to the high internal pressure, so that the possibility exists that the packaged material is damaged.

An object of the present invention is to provide a packing for compressed fibers, filaments or cabled tows which is subjected to high internal pressure and which permits to eliminate or substantially diminish the above mentioned disadvantages of the known packings while retaining as much as possible the features of conventional and proven packaging material.

High internal pressure is understood to be a pressure of at least 0.2 daN/cm$^2$.

It should be noted that, prior to the present invention, a packing for the purpose of holding compressed fibers, filaments or other threads without straps or similar holding means, has been considered an impossibility because of the pressure load. It has now been found, surprisingly, that this object may be achieved with a packing of compressed fibers, filaments or cabled tows subjected to an internal pressure of at least 0.2 daN/cm$^2$ and consisting of several parts and known materials, without using straps, belts or wires or the like when the individual parts of the outer wrapping of the packing are joined to each other at their overlapping areas by means of an adhesive capable of imparting to the glued portions a shear strength of at least 0.39 daN/cm$^2$.

The following example and the drawing FIG. 1 illustrate the packaging of the present invention, but are not intended to limit the scope of the invention. By reference to FIG. 1, numerals 1, 2 and 3 designate the outer portions of the wrapping and numeral 4 designates the areas of overlapping.

EXAMPLE

A tow of endless cellulose acetate filaments of a total titer of 50,000 dtex whose individual filaments had a titer of 2.8 dtex and 19 to 20 crinkles per centimeter was compressed by means of a known machine into a bale of density 0.37 g/cm$^3$.

The bale weighed 320 kg and had the following dimensions:

Length: 1287 mm
Width: 737 mm
Height: 843 mm.

This cabled filament bale under high pressure was packed with the following known materials:

(1) Top, bottom and sides of the bale each in one inner layer of aluminum foil coated with polyolefin on one side and with paper on the other.

(2) Top, bottom and sides of the bale each in an outer corrugated paper wrapping 1, 2 and 3.

The individual parts of the outer corrugated paper wrapping overlapped and were joined to each other over the entire overlap area 4 by means of a solvent type single component adhesive on neoprene/chloroprene/rubber basis. In view of the fact that the compressed filament cable had a tendency to expand, the packing had to withstand an internal pressure of 0.2 daN/cm$^2$, and also higher pressure up to about 3.3 daN/cm$^2$, for short periods of time, a value which corresponds to a required shear strength of the glued areas of at least 0.39 daN/cm$^2$.

The measured shear strength of the glued areas of the outer wrapping of the packing was 6.83 daN/cm$^2$ and therefore it withstood the 0.2 daN/cm$^2$ pressure and also the higher pressure of 3.3 daN/cm$^2$ without problem. Accordingly, the new packing also withstands all the usual stresses to which it is subjected during storage, transport and all other handling of the bales packaged with it.

The advantages which may be achieved with the packing according to the present invention as compared with known packings are in particular the elimination of the holding straps, belts, wires or the like required for the known packings.

As the outer wrapping, one may use in addition to corrugated paper also paper or aluminum foil, which may be lined with paper or other suitable material, and even unlined aluminum foil.

The adhesive on neoprene/chloroprene/rubber basis is marketed by 3M GmbH, Germany under the name "Fastbond", in a solvent mixture with about 22% solid content. Other adhesives which may be used are: the dispersion type adhesives, for instance dispersions of synthetic resins, which may be free of plasticizers or which may contain plasticizers, such as the substance marketed by Henkel, under the name Adhesin; contact adhesives such as "Fanacolle 1020-LO-V" marketed by Fanachemie, Switzerland. Also, the two-component-adhesives such as the adhesive marketed by Ciba-Geigy, under the name "XB2837 A+B". Another adhesive which may be used is the melt adhesive, marketed by 3M under the name "Jet-Melt 3744."

What is claimed is:

1. A packing for compressed fibers, filaments or cabled tows which is subjected to an internal pressure of at least 0.2 daN/cm$^2$, free of outer holding means which comprises an outer wrapping made of several parts, the individual parts of the outer wrapping of the packing overlapping and being held to each other in their overlapping areas by means of an adhesive which imparts to the glued areas a shear strength of at least 0.39 daN/cm$^2$.

2. The packing according to claim 1 wherein the adhesive is a neoprene-chloroprene-rubber composition.

3. The packing according to claim 1 wherein the filaments are cellulose acetate.

4. The packing according to claim 1 wherein the outer wrapping is corrugated paper.

5. The packing according to claim 1 wherein the outer wrapping is aluminum foil.

* * * * *